US006644254B2

(12) United States Patent
Harada et al.

(10) Patent No.: US 6,644,254 B2
(45) Date of Patent: Nov. 11, 2003

(54) VALVE TRAIN FOR INTERNAL COMBUSTION ENGINE

(75) Inventors: Takeya Harada, Wako (JP); Toshiki Kobayashi, Wako (JP); Noriyuki Yamada, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/045,050

(22) Filed: Jan. 15, 2002

(65) Prior Publication Data

US 2002/0092490 A1 Jul. 18, 2002

(30) Foreign Application Priority Data

Jan. 17, 2001 (JP) ..... 2001-009436

(51) Int. Cl.[7] ..... F01L 13/00; F01L 1/18

(52) U.S. Cl. ..... 123/90.16; 123/90.36; 123/90.39; 123/90.42

(58) Field of Search ..... 123/90.15, 90.16, 123/90.36, 90.39, 90.42

(56) References Cited

U.S. PATENT DOCUMENTS 4,537,165 A * 8/1985 Honda et al. ..... 123/90.16
4,829,948 A * 5/1989 Yoshida et al. ..... 123/90.16
4,887,563 A * 12/1989 Ishida et al. ..... 123/90.16
4,899,701 A * 2/1990 Inoue et al. ..... 123/90.16
4,962,732 A * 10/1990 Inoue et al. ..... 123/90.16
RE33,967 E * 6/1992 Honda et al. ..... 123/90.16

FOREIGN PATENT DOCUMENTS

JP 11-13443 1/1999

* cited by examiner

*Primary Examiner*—Weilun Lo
(74) *Attorney, Agent, or Firm*—Armstrong, Westerman & Hattori, LLP

(57) ABSTRACT

A valve train for an internal combustion engine includes a rocker shaft (9) provided with an oil passage, first and second rocker arms (7, 8) having support parts (7*a*, 8*a*) provided with bores (7*b*, 8*b*) to receive the rocker shaft (9) therein so as to be supported on the rocker shaft (9) for rocking motion, and a rocker arm interlocking mechanism (10) for selectively engaging or disengaging the first and the second rocker arms (7, 8). The first rocker arm (7) is provided with a pressure chamber (33) holding a piston (30) therein, a straight connecting passage 34 connected to the pressure chamber (33) and an oil passage (35)formed in the rocker shaft (9). An open end surface (7*b*1) of the bore (7*b*) of a first support wall (7*e*) of the rocker arm (7) is on an axially outer side of the pressure chamber (33). The straight connecting passage (34) is inclined to the axis of the bore (7*b*) so that an imaginary passage (39) on an extension of the connecting passage (34) extended toward the open end surface (7*b*1) intersects the open end surface (7*b*1). The outermost side surface (7*e*1) of the first support wall (7*e*) has an inclined section inclined to the axis of the bore (7*b*) along the connecting passage (34).

17 Claims, 5 Drawing Sheets

VALVE TRAIN FOR INTERNAL COMBUSTION ENGINE

BACKGROUND OF THE INVENTION

1. Field of the Invention

The present invention relates to a valve train for an internal combustion engine, provided with a hydraulic rocker arm interlocking mechanism for selectively engaging a plurality of rocker arms or disengaging the plurality of rocker arms.

2. Description of the Related Art

Referring to FIGS. 4 and 5 showing a valve train for an internal combustion engine of this type disclosed in JP-A13443/1999, the valve train includes a pair of intake valves $a_1$ and $a_2$ for each of a plurality of cylinders of a multiple-cylinder internal combustion engine, a first rocker arm $b_1$ for driving the intake valve $a_1$, a second rocker arm $b_2$ for driving the intake valve $a_2$, a free rocker arm $b_3$ capable of being independent of the intake valves $a_1$ and $a_2$, a rocker shaft, and a hydraulic rocker arm driving mode selecting device d. The rocker arms $b_1$ and $b_2$ are provided with openings $g_1$ to $g_3$ in parts thereof between tappet crews $e_1$ and $e_2$ to be engaged with the valve tips of the intake valves $a_1$ and $a_2$ and the rocker shaft c to receive rollers $f_1$ to $f_3$. Cam lobes of a camshaft p come into rolling contact with the rollers $f_1$ to $f_3$. The rollers $f_1$ to $f_3$ are supported for rotation on a tubular shaft $k_1$ supported on a first support wall $h_1$ and a second support wall $h_2$, a tubular shaft $k_2$ supported on a first support wall $h_3$ and a second support wall $h_4$, and a tubular shaft $k_3$ supported on a first support wall $h_5$ and a second support wall $h_6$, respectively. A pressure chamber n is formed in the first rocker arm $b_1$ between the first support wall $h_1$ and a timing piston m is slidably fitted in the tubular support shaft $k_1$. The first support wall $h_1$ is provided with a connecting passage s having one end opening into the pressure chamber n to into connect an oil passage r formed in the rocker shaft c and the pressure chamber n. The other end of the connecting passage s forms a through hole $s_0$ extending from a bore t, in which the rocker shaft c is fitted, through a side part of the first rocker arm $b_1$. The tappet screws $e_1$ and $e_2$ are supported on substantially entire part of walls forming tip parts of the rocker arms $b_1$ and $b_2$ including end parts of the support walls $h_1$, $h_2$, $h_3$ and $h_4$, and outer walls $w_1$ and $w_2$ on the radially outer side of the rollers $f_1$ and $f_2$.

In this prior art valve train, the connecting passage s having one end connected to the pressure chamber n and the other end connected to the through hole $s_0$ and formed in a support part u of the first rocker arm $b_1$, forming the bore t in which the rocker shaft c is fitted reduces the rigidity of the support part u. The tappet screws $e_1$ and $e_2$ can be sufficiently rigidly supported by substantially entire end parts of the rocker arms $b_1$ and $b_2$ when the rollers $f_1$ and $f_2$ of the prior art valve train are comparatively thin. When tappet screws are supported by substantially entire end parts of rocker arms in a valve train having comparatively thick rollers, the weight and inertia of the rocker arms increases. Although the rocker arms can be formed in lightweight structures if the tappet screws are supported only by the outer side walls, it is difficult to support the tappet screws highly rigidly because the supporting effect of the support walls is low.

SUMMARY OF THE INVENTION

The present invention has been made in view of such problems and it is a first object of the present invention to provide a valve train for an internal combustion engine, including a small, lightweight rocker arm provided with a pressure chamber, and a connecting passage connecting the pressure chamber and an oil passage formed in a rocker shaft, and having a rigid support part to be supported on the rocker shaft.

Another object of the present invention is to provide a valve train for an internal combustion engine, including a roller-type rocker arm having a rigid contact tip to be brought into contact with a valve of the internal combustion engine.

According to the present invention, a valve train for an internal combustion engine, comprises: a rocker shaft provided with an oil passage; a plurality of rocker arms having support parts provided with bores to receive the rocker shaft therein so as to be supported on the rocker shaft for rocking motion and operated for rocking motion by cams to operate valves of the internal combustion engine, specific one among the rocker arms being provided with a pressure chamber, a straight connecting passage formed in one specific end part thereof so as to extend obliquely to a direction parallel to an axis of the bore of the support part of the same specific rocker arm so as to be connected to an oil passage formed in the rocker shaft; and a rocker arm interlocking mechanism including a connecting piston fitted in the pressure chamber of the specific rocker arm so as to be axially displaced by pressure of working fluid supplied into the pressure chamber of the specific rocker arm, and capable of changing the position of the piston in the pressure chamber to engage the plurality of rocker arms or to disengage the plurality of rocker arms; wherein an open end surface of the bore of the specific rocker arm on the side of the specific end part is on an axially outer side of the pressure chamber; the linear connecting passage is inclined to the axis of the bore of the specific rocker arm so that an imaginary passage on an extension of the connecting passage extended toward the open end surface of the bore of the specific rocker arm intersects the open end surface; the outermost side surface of the specific end part has an inclined section inclined to the axis of the bore of the specific rocker arm along the connecting passage.

According to the present invention, the imaginary passage on the extension of the straight connecting passage formed in the specific end part of the specific rocker arm among the plurality of rocker arms is inclined to the axis of the bore so as to intersect the open end surface of the bore on the side of the specific end part. Therefore, any through hole is not formed in the support part opposite to the connecting passage with respect to the bore even when the connecting passage is formed by machining using a drill. Thus, the support part has a high rigidity and the specific rocker arm rocks stably when the internal combustion engine operates at high engine speeds. Since the open end surface of the bore formed in the support part projects axially beyond the pressure chamber, the connecting passage extends from the side of the support part toward the pressure chamber backward obliquely to the axis, and an outermost end surface extends obliquely backward along the connecting passage. Therefore, the specific rocker arm is miniaturized and the weight of the same is reduced accordingly. Since a space of a size corresponding to the retraction of the outermost side surface along the connecting passage is formed axially outside the outermost side surface of a part corresponding to the pressure chamber of the specific rocker arm, component parts of the valve train can be disposed in the space so that the rocker arms and the associated parts can be compactly arranged.

In the valve train according to the present invention, at least one of the plurality of rocker arms is a roller-type rocker arm having first and second support walls and a outer side wall defining an opening for holding a roller to be brought into rolling contact with the cam, the first and the second support wall are joined to the outer side wall at two corner parts, respectively, the first and the second support wall disposed axially opposite to each other hold opposite end parts of a support shaft supporting the roller for rotation, the outer side wall is disposed on the outer side of the roller with respect to a direction parallel to a diameter of the bore, and the contact part to be brought into contact with the valve of the internal combustion engine is supported on one of the corner parts.

Since the contact part of the roller-type rocker arm is supported on the corner part having a rigidity higher than that of the outer side wall forming the opening because the highly rigid first support wall is connected to the outer side wall, increase in size and weight to enhance the rigidity of the part of the rocker arm for supporting the contact part can be avoided. This effect is remarkable when a thick roller is employed.

In the valve train according to the present invention, the specific rocker arm may be a roller-type rocker arm, the specific axial end part may include the first support wall, the connecting passage may be formed in the first support wall, the first support wall may have a width along the axis of the bore greater than that of the second support wall, and the contact part may be supported on the corner part where the first support wall and the outer side wall are joined.

Since the first support wall provided with the connecting passage and having the width greater than that of the second support wall is joined to the outer side wall at the corner part supporting the contact part, the corner part supporting the contact part has a high rigidity, and, consequently, the valves of the internal combustion engine can be operated more stably when the internal combustion engine operates at high engine speeds. Since a part of the support part on the side of the contact part projects, pressure exerted on the rocker shaft by the support part resulting from a torsional moment produced by a force exerted on the roller by the cam and a force acting on the contact part can be reduced, which stabilizes the operation of the valves of the internal combustion engine.

In the valve train according to the present invention, the specific rocker arm is preferably a roller-type rocker arm, and the bore may have a wall surface including a circumferentially extending annular raised portion which protrudes radially inwardly of the bore and extends axially of the bore in a region between the connecting passage and the opening. This feature of the interior wall surface of the bore provides an advantage of increasing the rigidity of the first rocker arm.

In the valve train, the bore may have a wall surface including a circumferentially extending annular recessed portion which recedes radially outwardly of the bore and extends axially of the bore in a region corresponding to the opening. This feature of the interior wall surface of the bore provides an advantage of reducing the weight of the first rocker arm.

In the valve train, the bore may have wall surface portions extending in axial regions of the bore in which the first and second support walls are formed, respectively, the wall surface portions having a diameter smaller than that of a wall surface portion of the bore extending in an axial region in which the opening is formed. This feature of the interior wall surface portions of the bore provides an advantage of excellent lubrication in the mutually sliding portions of the rocker shaft and the first rocker arm.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
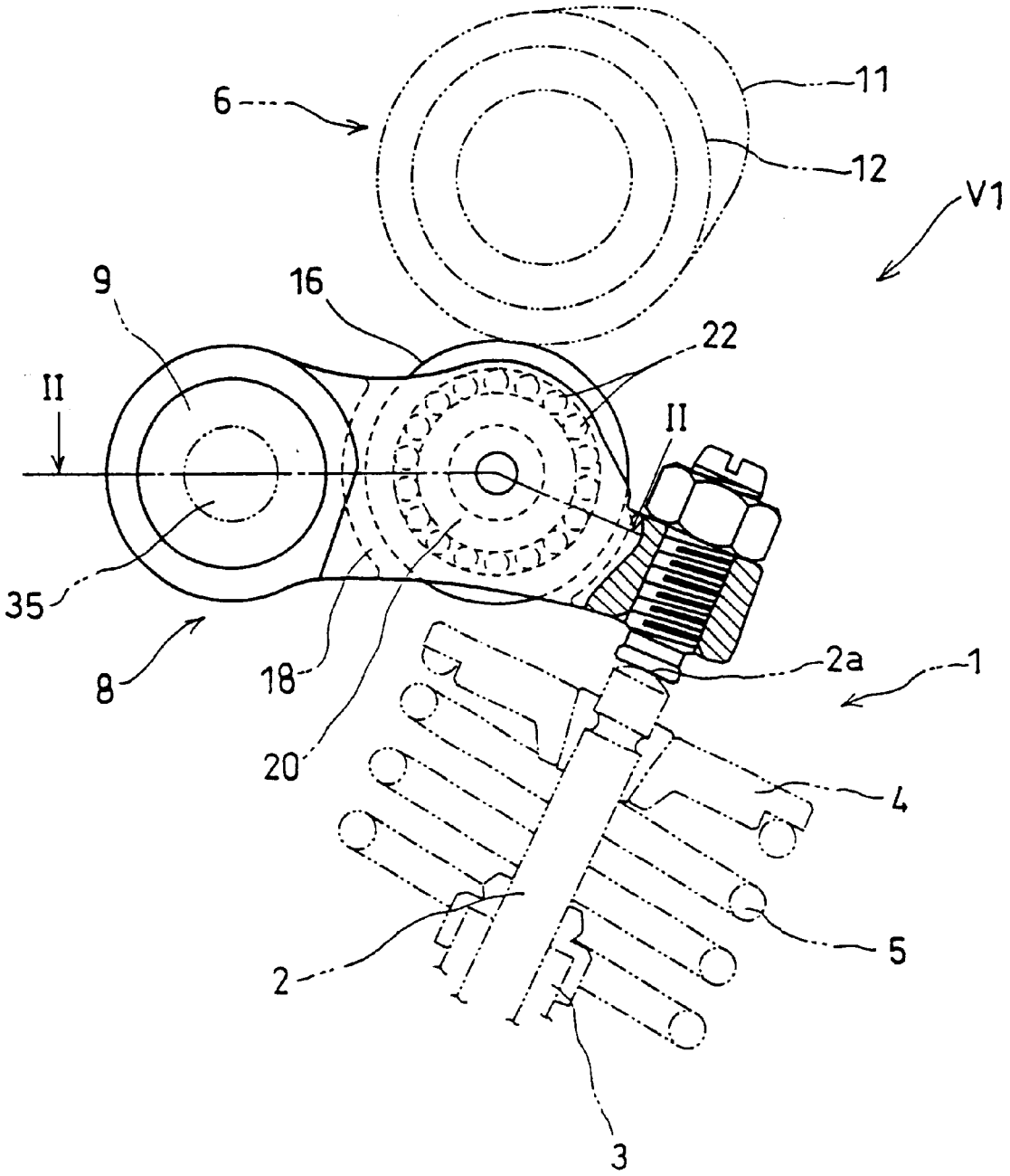
FIG. 1 is a partly sectional side elevation of a valve train in a first embodiment according to the present invention for an internal combustion engine.
Figure 2:
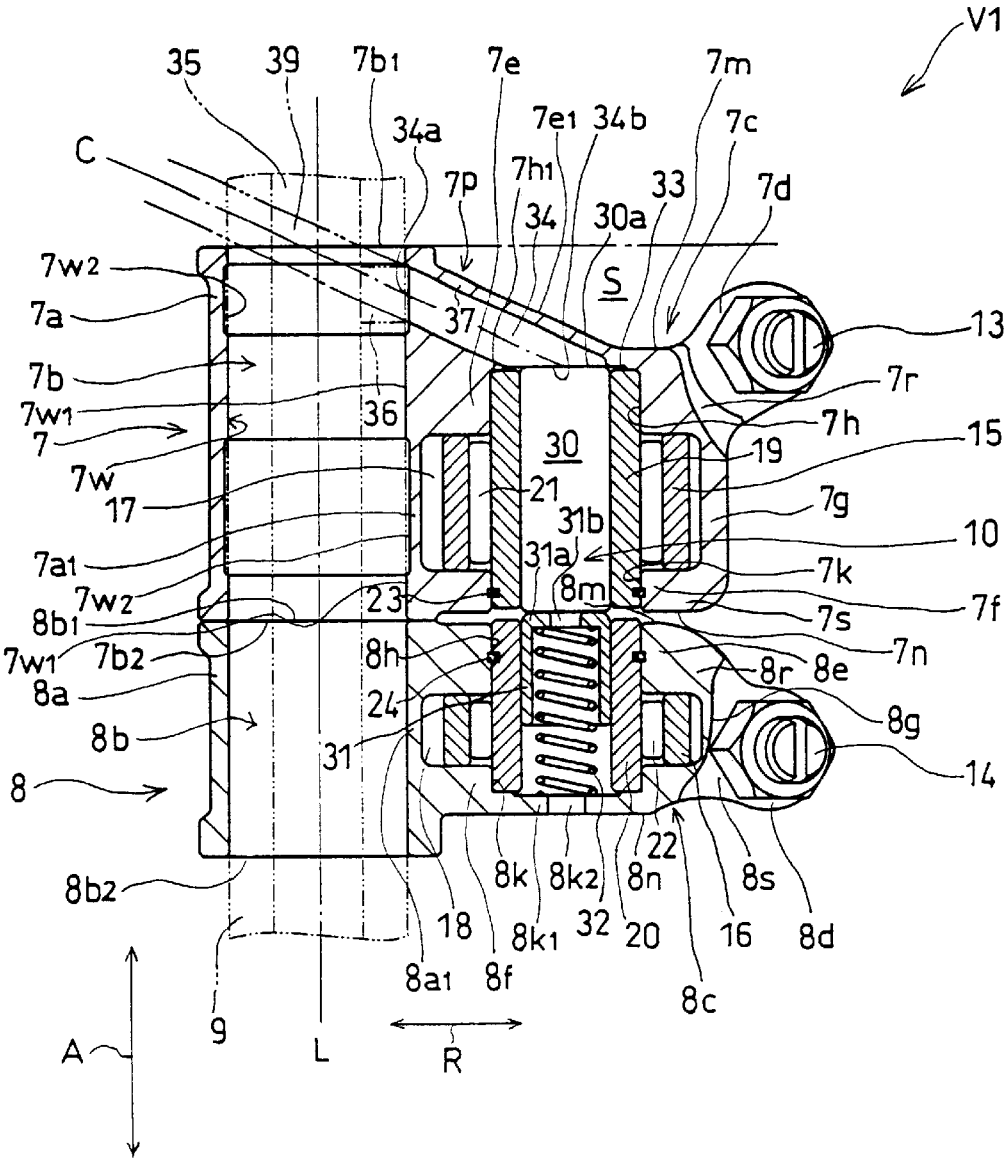
FIG. 2 is a sectional view taken on line II—II in FIG. 1.

A valve train in a first embodiment according to the present invention will be described with reference to FIGS. 1 and 2 as applied to an automotive DOHC four-stroke-cycle internal combustion engine (hereinafter, referred to simply as "engine"). Pistons are fitted for reciprocation in cylinders formed in a cylinder block. A cylinder head provided with intake ports and exhaust ports is joined to the upper end of the cylinder block. A pair of intake ports and a pair of exhaust ports are formed in the cylinder head for each cylinder. A pair of intake valves 1 for closing the pair of intake ports, and a pair of exhaust valves, not shown, for closing the exhaust ports are supported on the cylinder head. The intake valves 1 are operated for opening and closing by an intake valve train V1 including an intake camshaft 6. The exhaust valves are operated for opening and closing by an exhaust valve train including an exhaust camshaft.

The intake valve train V1 for operating the intake valves 1 for one of the cylinders will be described with reference to FIGS. 1 and 2. Each intake valve 1 has a valve stem 2 slidably fitted in a valve guide 3 pressed in the cylinder head. A retainer 4 is joined to an end part of the valve stem 2. A valve spring 5 is extended between the retainer 4 and the cylinder head to bias the intake valve 1 resiliently in a direction to close the intake port. The intake valve train V1 includes the intake camshaft 6 to which the power of a crankshaft driven for rotation by the pistons is transmitted by a transmission mechanism including a timing belt, a roller-type first rocker arm 7 for driving one of the pair of intake valves 1, a roller-type second rocker arm 8 for driving the other intake valve 1, a rocker shaft 9 disposed with its axis in parallel to the axis of the intake camshaft 6, fixedly supported on the cylinder head and supporting the rocker arms 7 and 8 for rocking motion, and a rocker arm interlocking mechanism 10 for selectively engaging or disengaging the rocker arms 7 and 8.

The intake camshaft 6 is provided with a first cam 11 for operating the first rocker arm 7, and a second cam 12 for operating the second rocker arm 8. The first cam 11 has a profile to lift the intake valve 1 through the first rocker arm 7 at a predetermined valve opening time by a predetermined lift. The profile of the first cam 11 has a circular base part having its center on the axis of the intake camshaft 6, and a lobe radially protruding from the circular base part. The second cam 12 has a circular profile having a radius equal to that of the circular base part of the profile of the first cam 11 and having its center on the axis of the intake camshaft 6 or has a profile having a circular base part having its center on the axis of the intake camshaft 6, and a lobe capable of keeping the associated intake valve 1 substantially inoperative or of slightly opening the associated intake valve 1.

The rocker arms 7 and 8 have support parts 7*a* and 8*a* provided with bores 7*b* and 8*b*, respectively. The rocker shaft 9 is inserted in the bores 7*b* and 8*b* of the support parts 7*a* and 8*a* to support the rocker arms 7 and 8 for rocking motion on the rocker shaft 9. The common axis L of the bores 7*b* and 8*b* coincides with the axis of the rocker shaft 9. The rocker arms 7 and 8 are supported contiguously on the rocker shaft 9. In the following description, the term "axial direction A" signifies either of directions indicated by the arrows A in FIG. 2 parallel to the axis L. End parts 7*c* and 8*c* extend radially from the support parts 7*a* and 8*a*. In the following description, the term "radial direction R" signifies either of directions indicated by the arrows R in FIG. 2 radial to the axis L. Tappet screw holding parts 7*d* and 8*d* protrude from the end parts 7*c* and 8*c*, respectively. Tappet screws 13 and 14, i.e., contact tips of the rocker arms 7 and 8 to be in contact with the intake valves 1, are held on the tappet screw holding parts 7*d* and 8*d*, respectively.

The roller-type first rocker arm 7 is provided with a roller 15 partly received in an opening 17 formed in a part of the rocker 7 between the bore 7*b* and the tappet screw 13. The opening 17 is defined by a first support wall 7*e*, a second support wall 7*f* facing opposite to the first support wall 7*e* with respect to the axial direction A, an inner side wall 7*a*1 forming the support part 7*a*, and an outer side wall 7*g* facing opposite to the inner side wall 7*a*1 with respect to the radial direction R. A bottomed, cylindrical first hole 7*h* having a bottom surface 7*h*1 is formed in the inner side surface of the first support wall 7*c* with its axis extended parallel to the axial direction A. A cylindrical second hole 7*k* is formed through the second support wall 7*f* with its axis extended in parallel to the axial direction A. A tubular support shaft 19 is fitted in the first hole 7*h* and the second hole 7*k*. A wide roller 15 is supported for rotation on the support shaft 19 by a plurality of needles 21 retained on the support shaft 19. The support shaft 19 is retained in place on the second support wall 7*f* by a retaining ring 23.

The first rocker arm 7 has a protruding part 7*p* extending between the support part 7*a* and the end part 7*c*. Thus, the part of the first rocker arm 7 in engagement with the rocker shaft 9 has a long length. The open end surface 7*b*1 of the bore 7*b* on the side of the first support wall 7*e* is included in a plane perpendicular to the axial direction A on the outer side of a plane perpendicular to the axial direction A and including an outer side surface 7*m*. The open end surface 7*b*2 of the bore 7*b* on the side of the second support wall 7*f* is included substantially in a plane perpendicular to the axial direction A and including the outer side surface 7*n*.

The distance between the tappet screws 13 and 14 is dependent on the distance with respect to the axial direction A between the pair of intake valves 1. The first support wall 7*e* and the second support wall 7*f* join with the outer side wall 7*g* to form corner parts 7*r* and 7*s*, respectively. The tappet screw holding part 7*d* projects from the corner part 7*r* where the first support wall 7*e* and the outer side wall 7*g* are joined. Thus the outer side wall 7*g* and the corner parts 7*r* and 7*s* form the end part 7*c*.

The roller-type second rocker arm 8 is provided with a roller 16 partly received in an opening 18 formed in a part of the rocker arm 8 between the bore 8*b* and the tappet screw 14. The opening 18 is defined by a first support wall 8*e*, a second support wall 8*f* facing opposite to the first support wall 8*e* with respect to the axial direction A, an inner side wall 8*a*1 forming the holding part 8*a*, and an outer side wall 8*g* facing opposite to the inner side wall 8*a*1 with respect to the radial direction R. A bottomed, cylindrical second hole 8*k* having a bottom defined by a bottom wall 8*k*1 is formed in the inner side surface of the second support wall 8*f* with its axis extended parallel to the axial direction A. A cylindrical first hole 8*h* is formed through the first support wall 8*e* with its axis extended in parallel to the axial direction A. A tubular support shaft 20 is fitted in the first hole 8*h* and the second hole 8*k*. A narrow roller 16, which is narrower than the roller 15, is supported for rotation on the support shaft 20 by a plurality of needles 22 retained on the support shaft 20. The support shaft 20 is retained in place on the first support wall 8*e* by a retaining ring 24.

An end part of the support part 8*a* of the second rocker arm 8 on the side of the first support wall 8*e* with respect to the axial direction A in contact with the end part of the support part 7*a* of the first rocker arm 7, i.e., the open end surface 8*b*1 of the bore 8*b*, is included substantially in a plane perpendicular to the axial direction A and including the outermost side surface 8*m* of the end part 8*c* of the second rocker arm 8. The other end of the support part 8*a*, i.e., the open end surface 8*b*2 of the bore 8*b*, projects slightly in the axial direction A from the outermost side surface 8*n* included in a plane perpendicular to the axial direction A.

The first support wall 8*e* and the second support wall 8*f* join with the outer side wall 8*g* to form corner parts 8*r* and 8*s*, respectively. The tappet screw holding part 8*d* projects from the corner part 8*s* where the second support wall 8*f* and the outer side wall 8*g* are joined. Thus the outer side wall 8*g* and the corner parts 8*r* and 8*s* form the end part 8*c*.

The rocker arm interlocking mechanism 10 for selectively engaging or disengaging the rocker arms 7 and 8 includes a cylindrical connecting piston 30 for engaging or disengaging the first rocker arm 7 and the second rocker arm 8, a control member 31 having a bottom wall 31*a* and formed in the shape of a bottomed cylinder in contact with the connecting piston 30, and a compression spring 32 pressing the control member 31 against connecting piston 30. The connecting piston 30 is fitted axially slidably in the tubular support shaft 19. A pressure chamber 33 is formed between the connecting piston 30 and the bottom surface 7*h*1 of the first hole 7*h* of the first rocker arm 7. A part of the connecting piston 30 slides into the bore of the tubular support shaft 20 to engage the first rocker arm 7 and the second rocker arm 8. The control member 31 is axially slidably fitted in the bore of the support shaft 20 and the bottom wall 31*a* is in contact with one end surface of the connecting piston 30. The bottom wall 31*a* of the control member 31 is provided in its central part with a through hole 31*b*. The compression spring 32 is compressed between the bottom wall 31*a* of the control member 31, and the bottom wall 8*k*1 defining the bottom of the second hole 8*k*. The bottom wall 8*k*1 is provided with a through hole 8*k*2 serving as a passage for air and lubricating oil. Thus, the first rocker arm 7 is a specific rocker arm among the rocker arms 7 and 8.

A straight connecting passage 34 having, for example, a circular cross section is formed in the first support wall 7*e* to connect the pressure chamber 33 to an oil passage 35 formed in the rocker shaft 9. A working fluid of a pressure regulated according to the operating speed of the engine by a control valve, not shown, is supplied into the oil passage 35. A connecting hole 36 is formed in the first rocker arm 7 so that the oil passage 35 and the connecting passage 34 are connected always regardless of the angular position of the rocking first rocker arm 7.

The connecting passage 34 is inclined to the axis L of the bore 7*b* so that an imaginary passage 39 on the extension of the connecting passage 34 from the open end surface 34*a* opening into the bore 7*b* toward the open end surface 7*b*1 of the first support wall 7*e* intersects the open end surface 7*b*1 and an oblique section of the imaginary passage 39 in a plane including the outer end surface of the first support wall 7*e* is included entirely in the open end surface 7*b*1.

The outermost side surface 7*e*1 of the first support wall 7*e* with respect to the axial direction A, i.e., the outer surface of a wall 37 forming the connecting passage 34, extends obliquely with respect to the axial direction A along the connecting passage 34 in an entire range from a part corresponding to the outermost end with respect to the radial direction R of the pressure chamber 33 to a protrusion 7*p* in the support part 7*a* corresponding to the open end surface 34*a*. Therefore, a space S is formed between a plane including the open end surface 7*b*1 and perpendicular to the axial direction A, and the outermost side surface 7*e*1, whereas any space would not be formed if the outermost side surface 7*e*1 were included in the plane as indicated by a chain line in FIG. 2. The outermost side surface 7*e*1 may be extended obliquely along the connecting passage 34 in parallel to the axis C of the connecting passage 34 as shown in FIG. 2, at an angle to the axis C or at an angle different from an angle at which the axis C is inclined to the axial direction A to the axial direction A, provided that the space S is formed.

The first rocker arm 7 has a greater dimension than the second rocker arm 8 in the axial direction A, and the bore 7*b* in the first rocker arm 7 has portions of different radii. The bore 7*b* has a wall surface 7*w* including annular raised portions 7*w*1 which protrude radially inwardly of the bore and form portions of reduced inner diameter. These annular raised portions 7*w*1 extend in the axial direction A substantially throughout the axial region between the open end surface 34*a* of the connecting passage 34 in the first support wall 7*e* and the opening 17 in the second support wall 7*f*, and substantially between the opening 17 and the open end surface 7*b*2 of the bore 7*b* respectively.

The wall surface 7*w* of the bore 7*b* also has annular recessed portions 7*w*2 which recede radially outwardly of the bore and form portions of enlarged inner diameter. These annular recessed portions 7*w*2 extend in the axial direction substantially throughout the axial region occupied by the pen end surface 34*a* in the first support wall 7*e*, and substantially throughout the axial region occupied by the opening 17. It will be understood that portions of the bore 7*b* corresponding to the axial regions in which the first and second support walls 7*e* and 7*f* are formed have a diameter smaller that the diameter of the portion of the bore 7*b* in which the opening 17 is formed.

The first rocker arm 7 is in sliding contact with the rocker shaft 9 in the axial region of the annular raised portions 7*w*1, while the annular recessed portions 7*w*2 define between the first rocker arm 7 and the rocker shaft 9 anuular spaces serving to store lubricant that has flowed through the clearnce between the first rocker arm 7 and the rocker shaft 9.

The portions of the support part 7*a* corresponding to the first and second support walls 7*e* and 7*f* support the support shaft 19 to which the load from the rotating first cam 11 is imposed through the rollers 15. Since the wall surface 7*w* is provided with the annular raised portions 7*w*1 that extend circumferentially of the bore, the rigidity of the first rocker arm 7 is increased. On the other hand, the portion of the support part 7*a* corresponding to the opening 17 does not need so high a rigidity compared with the portions corresponding to the first and second support walls 7*e* and 7*f*. In such portion, the wall surface 7*w* is formed with the annular recessed portions 7*w*2, which serve to reduce the weight of the first rocker arm 7. Furthermore, lubricant stored in the spaces between the rocker shaft 9 and the enlarged diameter portions of the support part 7*a* serves to provide an excellent lubrication in the mutually sliding portions of the rocker shaft 9 and the first rocker arm 7, whereby a smooth rocking movement of the rocker arm 7 having a large dimension in the axial direction A is ensured.

The operation of the rocker arm interlocking mechanism 10 for the intake valve train V1 will be explained. While the engine is operating at engine speeds in a low engine speed range, the working fluid of a low pressure regulated by the control valve is supplied through the connecting passage 34 into the pressure chamber 33. Consequently, the end surface of the connecting piston 30 in contact with the control member 31 lies between the first rocker arm 7 and the second rocker arm 8 and hence the first rocker arm 7 and the second rocker arm 8 are disengaged. Thus, the rocker arms 7 and 8 are able to rock independently; the first cam 11 drives the first rocker arm 7 so that the first rocker arm 7 lifts the associated intake valve 1 by the predetermined lift at a predetermined time point, and the second rocker arm 8 holds the associated intake valve in a closed state or substantially in a closed state.

While the engine is operating at engine speeds in a high engine speed range, the working fluid of a high pressure regulated by the control valve is supplied through the connecting passage 34 into the pressure chamber 33. Consequently, the connecting piston 30 pushes the control member 31 against the resilience of the compression spring 32 and an end part thereof enters the bore of the support shaft 20, so that the connecting piston 30 is fitted in both the bores of the support shafts 19 and 20 to engage the rocker arms 7 and 8. Thus, the first cam 11 drives both the first rocker arm 7 and the second rocker arm 8 so that the first rocker arm 7 and the second rocker arm lift the associated intake valves 1 by the predetermined lift at a predetermined time point.

When the engine speed decreases from the high engine speed range to the low engine speed range, the control valve reduces the pressure of the working fluid. Consequently, the pressure in the pressure chamber 33 decreases the connecting piston 30 is pushed back into the bore of the support shaft 19 by the resilience of the compression spring 32 as shown in FIG. 2.

The operation and effect of the valve train in the first embodiment will be described hereinafter. The straight connecting passage 34 formed in the first support wall 7*e* of the first rocker arm 7 extends obliquely so that the imaginary passage 39 intersects the open end surface 7*b*1 of the bore 7*b* on the first support wall 7*e*. Therefore, when forming the connecting passage 34 by machining using, for example, a drill, any through hole is not formed in the support part 7*a* at a position on the extension of the connecting passage 34. Thus, the rigidity of the support part 7*a* is not reduced and the first rocker arm 7 rocks stably while the engine is operating in the high engine speed range. Since the open end surface 7*b*1 of the bore 7*b* of the support part 7*a* is included in a plane on the outer side of a plane including the bottom surface 7*h*1 of the first hole 7*h* of the first rocker arm 7, the connecting passage 34 extends obliquely from the support part 7*a* to the pressure chamber 33, and the outermost side surface 7*e*1 of the first support wall 7*e* extends obliquely along the connecting passage 34. Thus, the first rocker arm 7 is formed in a small size and in a lightweight structure. The space S defined by a section of the outermost side surface 7*e*1 of the first support wall 7*e* corresponding to the pressure chamber 33 can be used for disposing the component parts of the valve train and, consequently, the first rocker arm 7 and the component parts can be disposed in a compact arrangement.

In the intake valve train V1 including the rocker arm interlocking mechanism 10, the first rocker arm 7 and the second rocker arm 8 for each cylinder, the tappet screw 13 is held on the highly rigid corner part 7*r* at the joint of the highly rigid first support wall 7*e* and the outer side wall 7*g*. Therefore, although the first rocker arm 7 is provided with the wide roller 15, the tappet screw 13 can be rigidly supported and the size and the weight of the first rocker arm 7 do not need to be increased to enhance the rigidity of the part supporting the tappet screw 13.

The corner part 7*r* supporting the tappet screw 13 is at the joint of the first support wall 7*e* formed in an increased thickness greater than that of the second support wall 7*f* to form the connecting passage 34 therein, and the outer side wall 7*g*. The corner part 7*r* has a high rigidity and hence the intake valve 1 can be stable controlled while the engine is operating in the high engine speed range. Since the support part 7*a* has the protruding part 7*p* on the side of the tappet screw 13 with respect to the roller 15, pressure exerted on the rocker shaft 9 supporting the support part 7*a* by the torsional moment produced by a force exerted on the roller 15 by the first cam 11 and a force exerted on the tappet screw 13 can be reduced, which stabilizes the operation of the intake valve 1.

Since the connecting passage 34 is straight and the open end 34*b* of the connecting passage 34 opening into the pressure chamber corresponds to the entire working surface 30*a* of the connecting piston 30, the pressure of the working fluid is not applied in radial direction to the connecting piston 30 and the connecting piston is not pressed against the inner circumference of the support shaft 19. Therefore, the resistance of the support shaft 19 against the axial movement of the connecting piston 30 is reduced, the connecting piston 30 can be displaced in satisfactory response to the variation of the pressure in the pressure chamber 33, and the rocker arm interlocking mechanism 10 operates smoothly.

Figure 3:
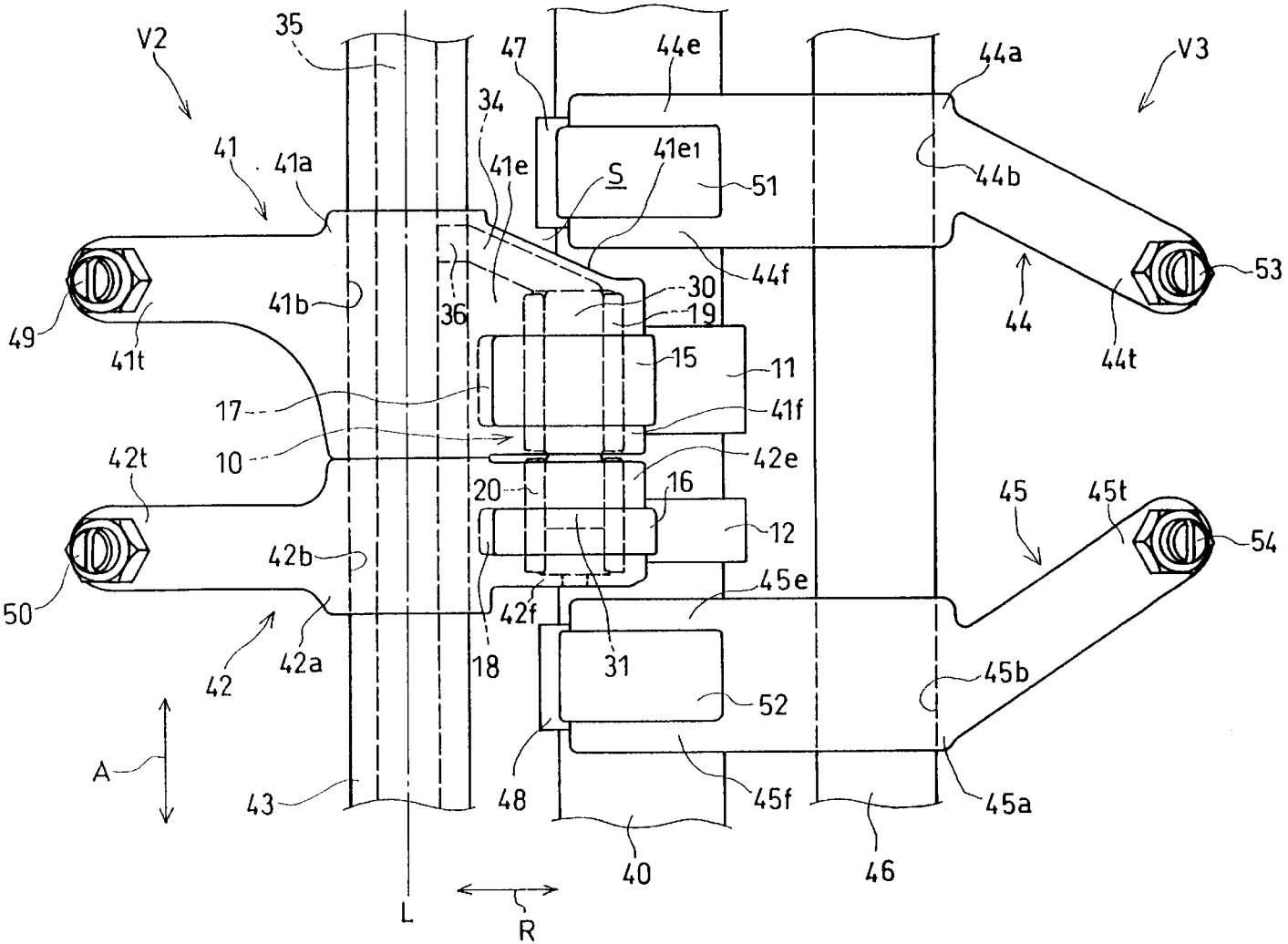
FIG. 3 is a plan view of a valve train in a second embodiment according to the present invention for an internal combustion engine.
Figure 4:
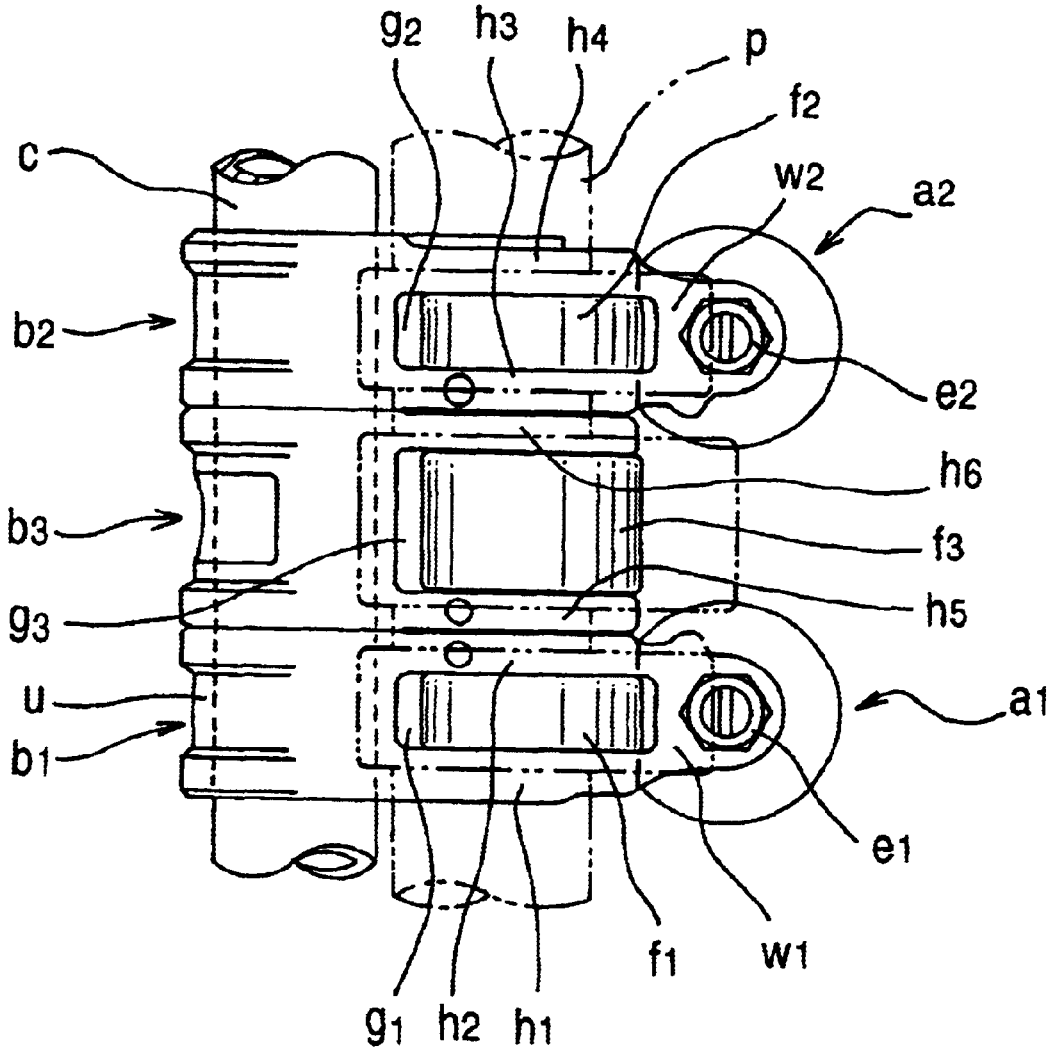
Fig.4 PRIOR ART
FIG. 4 is a plan view of a prior art valve train for an internal combustion engine.
Figure 5:
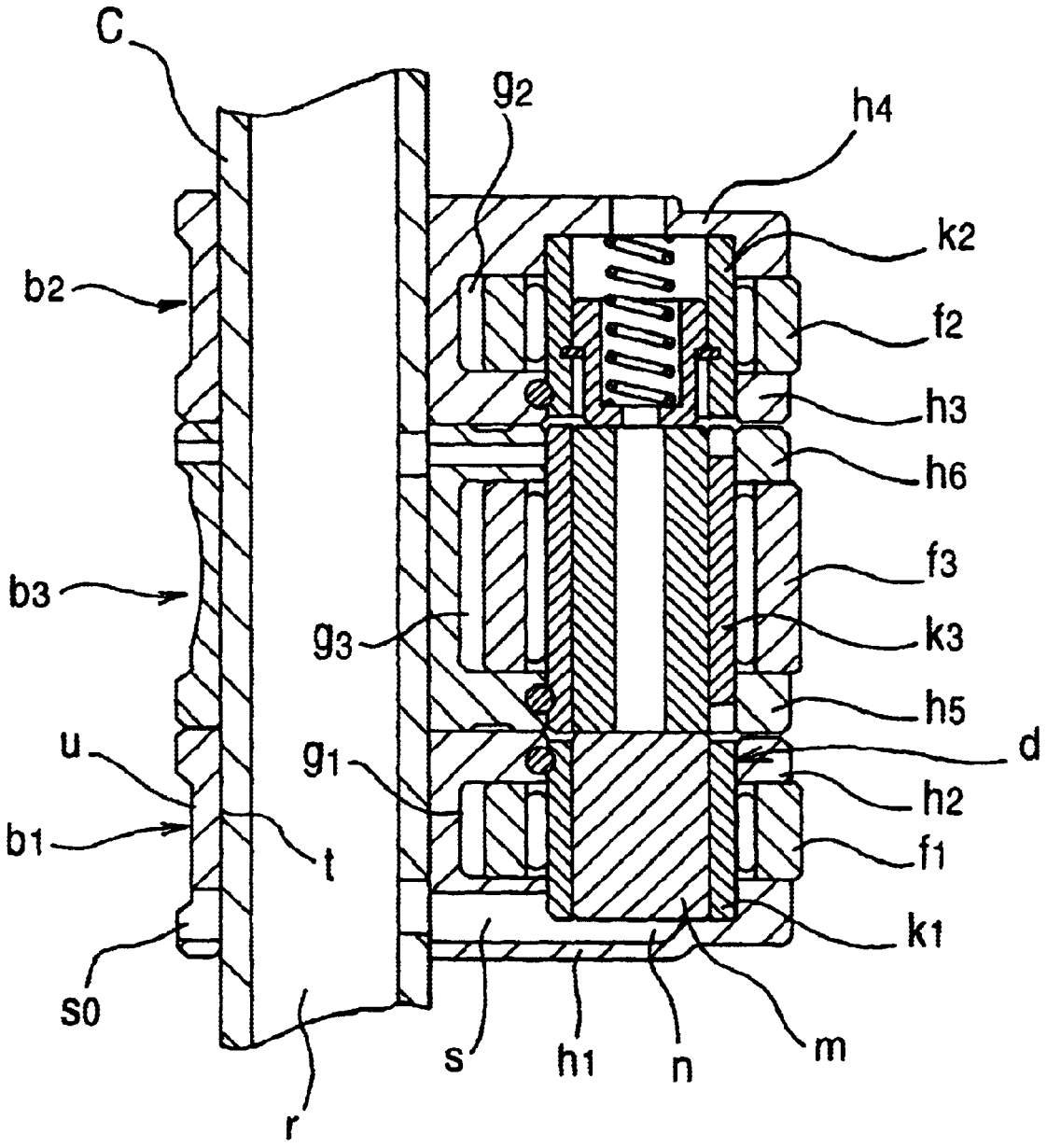
Fig.5 PRIOR ART
FIG. 5 is a sectional view of the valve train shown in FIG. 4.

A valve train in a second embodiment according to the present invention for an internal combustion engine will be described with reference to FIG. 3, in which parts like or corresponding to those of the valve train in the first embodiment are denoted by the same reference characters and the description thereof will be omitted. The valve train in the second embodiment will be described as applied to a SOHC four-stroke-cycle internal combustion engine (hereinafter, referred to simply as "engine") provided with a single camshaft 40 for operating both the intake rocker arms and the exhaust rocker arms.

A cylinder head included in the engine is provided with a pair of intake valves, not shown, and a pair of exhaust valves, not shown, for one cylinder. The intake valves are operated by an intake valve train V2 including the camshaft 40, and the exhaust valves are operated by an exhaust valve train V3 including the camshaft 40.

The intake valve train V2 includes the camshaft 40, a first intake rocker arm 41 for driving one of the pair of intake valves and a second intake rocker arm 42 for driving the other intake valve, an intake rocker shaft 43 fixedly held on the cylinder head and supporting the intake rocker arms 41 and 42 for rocking motion, and a rocker arm interlocking mechanism 10 for selectively engaging or disengaging the intake rocker arms 41 and 42. The intake rocker shaft 43, the rocker arm interlocking mechanism 10, a pressure chamber 33 and a connecting passage 34 are the same in construction as those of the valve train in the first embodiment. The exhaust valve train V3 includes the camshaft 40, a roller-type first exhaust rocker arm 44 for operating one of the pair of exhaust valves, a roller-type second exhaust rocker arm 45 for operating the other exhaust valve, and an exhaust rocker shaft 46 fixedly held on the cylinder head and supporting the exhaust rocker arms 44 and 45. The rocker shafts 43 and 46 are disposed with their axes extended in parallel to the axis of the camshaft 40 on a side opposite to the side of the combustion chamber with respect to the camshaft 40.

The camshaft 40 is provided with a first intake cam 11 and a second intake cam 12, which correspond respectively to the first cam 11 and the second cam 12 of the valve train in the first embodiment, a first exhaust cam 47 for operating the first exhaust rocker arm 44, and a second exhaust cam 48 for operating the second exhaust rocker arm 45. The first exhaust cam 47 and the second exhaust cam 48 are disposed on the axially outer sides of the intake cams 11 and 12, respectively. The exhaust cams 47 and 48 have the same cam profile for lifting the pair of exhaust valves by a predetermined lift at a predetermined valve opening time.

The first intake rocker arm 41 and the second intake rocker arm 42 differ from those of the first embodiment in that end parts of the intake rocker arms 41 and 42 respectively holding rollers 15 and 16, and end parts 41*t* and 42*t* of the same respectively holding tappet screws 49 and 50 extend on the opposite sides of the support parts 41*a* and 42*a* having the bores 41*b* and 42*b*, respectively. The intake rocker arms 41 and 42 are the same in other respects as those of the first embodiment. The intake rocker arms 41 and 42 are provided with openings 17 and 18, respectively. The openings 17 and 18 are open in the radial direction R.

The roller-type exhaust rocker arms 44 and 45 have support parts 44*a* and 45*a* provided with bores 44*b* and 45*b*, respectively. The exhaust rocker shaft 46 is fitted in the bores 44*b* and 45*b* of the support parts 44*a* and 45*a* to support the rocker arms 44 and 45 for rocking motion. Tubular rollers 51 and 52 to be brought into contact with the exhaust cams 47 and 48 are supported on parts of the rocker arms 44 and 45 extending on one side of the bores 44*b* and 45*b*, respectively, and adjustable tappet screws 53 and 53, i.e., contact tips to be brought into contact with the exhaust valves, are held on end parts 44*t* and 45*t* extending on the other side of the bores 44*b* and 45*b*. The rollers 51 and 52 are disposed in openings formed in the exhaust rocker arms 44 and 45, respectively, similarly to the rollers 15 and 16 supported on the intake rocker arms 41 and 42.

The first exhaust rocker arm 44 has opposite support walls 44*e* and 44*f* supporting the roller 51. The support wall 44*f* on the side of the first intake rocker arm 41, and a part of the roller 51 are disposed near the first support wall 41*e* of the first intake rocker arm 41 in a space S extending on the outer side of the first support wall 41*e* with respect to the axial direction A. The second exhaust rocker arm 45 has opposite support walls 45*e* and 45*f* supporting the roller 52. The support wall 45*e* on the side of the second intake rocker arm 42 is disposed near the second support wall 42*f* of the second intake rocker arm 42 on the outer side of the second support wall 42*f* with respect to the axial direction A.

The valve train in the second embodiment exercises the following operations and effects, in addition to those brought about by the oblique connecting passages 34 similar to those exercised by the valve train in the first embodiment. Since the support wall 44*f* the first exhaust rocker arm 44 and the part of the roller 51 are disposed near the outermost side surface 41*e*1 of the first support wall 41*e* with respect to the axial direction A in the space S, the axial length, i.e., length along the axis of the camshaft 40, of the axial arrangement of the first intake rocker arm 41, the second intake rocker arm 42, the first exhaust rocker arm 44 and the second rocker arm 45 is short, and the intake valve train V2 and the exhaust valve train V3 can be formed in a compact axial arrangement.

Modifications of the foregoing embodiments will be described hereinafter. Although the second cam 12 in the foregoing embodiment keeps the associated intake valve 1 inoperative or substantially inoperative, the second cam 12 may have a cam profile to lift the associated intake valve 1 by a predetermined lift at a predetermined time. When both the first cam 11 and the second cam 12 are formed so as to operate the associated intake valves 1, either the first cam 11 or the second cam 12 is formed so as to open the associated intake valve 1 at a valve opening time earlier than that when the other opens the associated intake valve 1, to close the associated intake valve 1 at a valve closing time later than that when the other closes the associated intake valve 1, and to lift the associated intake valve 1 by a lift greater than that by which the other lifts the associated intake valve 1. When the intake valve train provided with such intake cams are employed, an exhaust valve train for operating the exhaust valves of each cylinder may be provided with a pair of exhaust cams having different cam profiles and may be provided with a valve interlocking mechanism similar to the valve interlocking mechanism 10.

Although the entire outermost side surface 7*e*1 of the first rocker arm 7 extends obliquely between the radially outermost end of the pressure chamber 33 and protruding part 7*p* of the open end surface 34*a* of the support part 7*a* in the foregoing embodiment, a space S can be formed even if only a part of the outermost side surface 7*e*1 is extended obliquely.

A connecting passage similar to that of the foregoing embodiment may be formed in three or more rocker arms including a pair of rocker arms having contact tips to be brought into contact with a pair of intake valves or a pair of exhaust valves for each cylinder, and at least one rocker arm capable of operating the pair of intake or exhaust valves when engaged and of becoming inoperative when disengaged.

Although the rocker arms are provided with the tappet screws as contact parts to be brought into contact with the intake or exhaust valves, contact tips of the rocker arms may be used as the contact parts to be brought into contact with the intake or exhaust valves.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A valve train for an internal combustion engine, comprising:

a rocker shaft provided wit an oil passage therein;

a plurality of rocker arms having support parts provided with bores, respectively, to receive the rocker shaft therein so as to be supported on the rocker shaft for rocking motion and operated for the rocking motion by cams to operate valves of the internal combustion engine, one of said rocker arms being provide with a pressure chamber and a connecting passage formed in one end part of the one rocker arm, said connecting passage extending obliquely to a direction parallel to an axis of the bore of the support part of said one rocker arm and being connected, through an open end of the connecting passage, to said oil passage formed in the rocker shaft, said bore of said one rocker arm having an open end surface on the side of said one end part;

said connecting passage being directed toward said open end surface of the one rocker arm and inclined to said axis of the bore of said one rocker arm so that an imaginary passage forming an extension of the connecting passage toward said open end surface intersects the open end surface;

a rocker arm interlocking mechanism including a connecting piston fitted in the pressure chamber of said one rocker arm so as to be displaced in a direction parallel to said axis by pressure of working fluid supplied into the pressure chamber of the one rocker arm, said rocker arm interlocking mechanism being operable to change the position of the connecting piston in the pressure chamber to engage the plurality of rocker arms or disengage the plurality of rocker arms; and a roller-receiving opening formed in said one rocker arm to accommodate a roller, said connecting passage extending from said pressure chamber in a direction away from said roller-receiving opening to said open end surface of the one rocker arm.

2. A valve train for an internal combustion engine, comprising:

a rocker shaft provided with an oil passage therein;

a plurality of rocker arms having support parts provided with bores to receive the rocker shaft therein so as to be supported on the rocker shaft for rocking motion and operated for the rocking motion by cams to operate valves the internal combustion engine, specific one among the rocker arms being provided with a pressure chamber and a connecting passage formed in one specific end part of the specific rocker arm so as to extend obliquely to a direction parallel to an axis of the bore of the support part of the same specific rocker arm so as to be connected to said oil passage formed in the rocker shaft; and a rocker arm interlocking mechanism including a connecting piston fitted in the pressure chamber of the specific rocker arm so as to be displaced in a direction parallel to said axis by pressure of working fluid supplied into the pressure chamber of the specific rocker arm, said rocker arm interlocking mechanism being operable to change the position of the piston in the pressure chamber to engage the plurality of rocker arms or disengage the plurality of rocker arms;

wherein the bore of the specific rocker arm has an open end surface on the side of the specific end part and on an axially outer side of the pressure chamber; the connecting passage is inclined to the axis of the bore of the specific rocker arm so that an imaginary passage on an extension of the connecting passage extended toward the open end surface of the bore of the specific rocker arm intersects the open end surface; and the specific end part has an outermost side surface inclined to the axis of the bore of the specific rocker arm along the connecting passage, and wherein at least one of the plurality of rocker arms is a roller-type rocker arm having first and second support walls and an outer slide wall defining an opening for holding a roller to be brought into rolling contact with a cam, the first and second support walls are joined to the outer side wall at two corner parts, respectively, the first and second support walls disposed axially opposite to each other hold opposite end parts of a support shaft supporting the roller for rotation, the outer side wall is disposed on an outer side of the roller with respect to a direction parallel to a diameter of the bore, and a contact part to be brought into contact with a valve of the internal combustion engine is supported on one of the corner parts.

3. The valve train according to claim 2, wherein the specific rocker arm is a roller-type rocker arm, the specific axial end part includes the first support wall, the connecting passage is formed in the first support wall, the first support wall has a width along the axis of the bore greater than that of the second support wall, and the contact part is supported on the corner part where the first support wall and the outer side wall are joined.

4. The valve train according to claim 2, wherein the specific rocker arm is a roller-type rocker arm, and said bore has a wall surface including a circumferentially extending annular raised portion which protrudes radially inwardly of the bore and extends axially of the bore in a region between said connecting passage and said opening.

5. The valve train according to claim 2, wherein said bore has a wall surface including a circumferentially extending annular recessed portion which recedes radially outwardly of the bore and extends axially of the bore in a region corresponding to said opening.

6. The valve train according to claim 2, wherein said bore has wall surface portions extending in axial regions of the bore in which said first and second support walls are formed, respectively, said wall surface portions having a diameter smaller than that of a wall surface portion of the bore extending in an axial region in which said opening is formed.

7. A valve train for an internal combustion engine, comprising:

a rocker shaft provided with an oil passage therein;

a plurality of rocker arms having support parts provided with bores, respectively, to receive the rocker shaft therein so as to be supported on the rocker shaft for rocking motion and operated for the rocking motion by cams to operate valves of the internal combustion engine, one of said rocker arms being provide with a pressure chamber and a connecting passage formed in one end part of the one rocker arm, said connecting passage extending obliquely to a direction parallel to an axis of the bore of the support part of said one rocker arm and being connected, through an open end of said connecting passage, to said oil passage formed in the rocker shaft, said bore of said one rocker arm having an open end surface on the side of said one end part; and a rocker arm interlocking mechanism including a connecting piston fitted in the pressure chamber of said one rocker arm so as to be displaced in a direction parallel to said axis by pressure of working fluid supplied into the pressure chamber of the one rocker arm, said rocker arm interlocking mechanism being operable to change the position of the connecting piston in the pressure chamber to engage the plurality of rocker arms or disengage the plurality of rocker arms;

said connecting passage being directed toward said open end surface of the one rocker arm and inclined to said axis of the bore of said one rocker arm so that an imaginary passage forming an extension of the connecting passage toward said open end surface intersects the open end surface, said connecting passage extending from said pressure chamber in a direction away from said pressure chamber to said open end surface of the one rocker arm.

8. The valve train for an internal combustion engine according to claim 7, wherein said imaginary passage intersects the pen end surface entirely within the area of said bore of the one rocker arm.

9. The valve train for an internal combustion engine according to claim 8, further comprising a roller-receiving opening formed in said one rocker arm to accommodate rollers, said connecting passage extending from said pressure chamber in a direction away from said roller-receiving opening to said open end surface of the one rocker arm.

10. The valve train for an internal combustion engine according to claim 7, wherein said connecting passage extends from said pressure chamber in a direction away from a rocker arm adjoining the one rocker arm to said open end surface of the one rocker arm.

11. The valve train for an internal combustion engine according to claim 10, wherein said one rocker arm has a valve-actuating part, and a center of said open end of the connecting passage is disposed at an outer position of the one rocker arm with respect to the direction of said axis relative to a center of said valve-actuating part.

12. The valve train for an internal combustion engine according to claim 10, wherein said one rocker arm has a valve-actuating part, and said open end surface of the one rocker arm is disposed at an outer position of the one rocker arm with respect to the direction of said axis relative to a center of said valve-actuating part.

13. The valve train for an internal combustion engine according to claim 7, further comprising a roller-receiving operating formed in said one rocker arm to accommodate rollers, said connecting passage extending from said pressure chamber in a direction away from said roller-receiving opening to said open end surface of the one rocker arm.

14. The valve train for an internal combustion engine according to claim 7, wherein said one end part has an outermost side surface formed along the connecting passage and inclined to the axis of the bore of said one rocker arm; said outermost side surface being inclined such that as it extends radially outward with respect to the axis of the bore, it is farther away from an imaginary plane including said open end surface and extending perpendicularly to the axis of the bore.

15. The valve train for an internal combustion engine according to claim 1, wherein said connecting passage extends from said pressure chamber in a direction away from a rocker arm adjoining the one rocker arm to said open end surface of the one rocker arm.

16. The valve train for an internal combustion engine according to claim 1, wherein said one end part has an outermost side surface formed along the connecting passage and inclined to the axis of the bore of said one rocker arm; said outermost side surface being inclined such that as it extends radially outward with respect to the axis of the bore, it becomes farther away from an imaginary plane including said open end surface and extending perpendicularly to the axis of the bore.

17. The valve train for an internal combustion engine according to claim 1, wherein said imaginary passage intersects the open end surface entirely within the area of said bore of the one rocker arm.

* * * * *